US008960626B1

(12) United States Patent
Taylor

(10) Patent No.: US 8,960,626 B1
(45) Date of Patent: Feb. 24, 2015

(54) NO-STICK COASTER SYSTEM

(76) Inventor: Larry J. Taylor, Mulberry, FL (US)

( * ) Notice: Subject to any disclaimer, the term of this patent is extended or adjusted under 35 U.S.C. 154(b) by 205 days.

(21) Appl. No.: 12/928,282

(22) Filed: Dec. 8, 2010

Related U.S. Application Data

(63) Continuation-in-part of application No. 12/924,406, filed on Sep. 27, 2010.

(51) Int. Cl.
*A47B 91/00* (2006.01)

(52) U.S. Cl.
USPC ..... 248/346.11

(58) Field of Classification Search
USPC ..... 248/346.11; 220/740, 849; 215/376, 215/392, 394, 393
See application file for complete search history.

(56) References Cited

U.S. PATENT DOCUMENTS

| | | | | | |
|---|---|---|---|---|---|
| 2,006,238 | A | * | 6/1935 | Florman et al. | 215/394 |
| 2,017,168 | A | * | 10/1935 | Sanders | 215/394 |
| 2,033,295 | A | * | 3/1936 | Parkin | 220/849 |
| 2,496,157 | A | * | 1/1950 | Gaudino | 248/346.11 |
| 2,595,961 | A | * | 5/1952 | Layne | 248/346.11 |
| 2,641,911 | A | * | 6/1953 | Raymond et al. | 248/346.11 |
| 2,652,703 | A | * | 9/1953 | Keegan | 248/346.11 |
| 2,709,905 | A | * | 6/1955 | Dunlap | 248/346.11 |
| 2,781,651 | A | * | 2/1957 | Cutler | 248/346.11 |
| 2,989,205 | A | * | 6/1961 | Yaws | 248/346.11 |
| 3,257,092 | A | * | 6/1966 | Blundell | 248/346.11 |
| 3,268,198 | A | * | 8/1966 | Swett | 248/346.11 |
| 3,363,869 | A | * | 1/1968 | Blundell | 248/346.11 |
| 3,610,456 | A | * | 10/1971 | Marsh | 215/376 |
| 3,633,863 | A | * | 1/1972 | Abbey | 248/346.11 |
| 3,768,849 | A | * | 10/1973 | Sytko | 292/327 |
| 4,336,574 | A | * | 6/1982 | Goodman | 362/101 |
| 4,830,182 | A | * | 5/1989 | Nakazato et al. | 206/454 |
| 4,836,488 | A | * | 6/1989 | Ross | 248/346.11 |
| 4,858,872 | A | * | 8/1989 | Witt | 248/346.11 |
| 5,273,182 | A | * | 12/1993 | Laybourne | 220/740 |
| 5,307,250 | A | * | 4/1994 | Pearson | 362/101 |
| 5,503,199 | A | * | 4/1996 | Whitley et al. | 141/312 |
| 5,507,324 | A | * | 4/1996 | Whitley et al. | 141/59 |
| 5,582,314 | A | * | 12/1996 | Quinn et al. | 220/326 |
| 5,695,270 | A | * | 12/1997 | Collet | 362/34 |
| D408,227 | S | * | 4/1999 | Swann, Jr. | D7/624.1 |
| 5,908,037 | A | * | 6/1999 | Pierson | 132/293 |
| 6,089,519 | A | * | 7/2000 | Laybourne | 248/346.11 |

* cited by examiner

*Primary Examiner* — Kimberly Wood

(57) ABSTRACT

A bottom portion is in a cylindrical configuration and has an imperforate base below and an open top above and a side wall there between forming an upper chamber. A similarly configured top portion is provided to form a lower chamber. The base of the top portion has a plurality of apertures. A hinge couples the top and bottom portions. The hinge is adapted to pivot the top portion between an operative closed orientation and an inoperative open orientation. In this operative closed orientation the top portion is overlying the bottom portion. In the inoperative open orientation the top and bottom portions are positioned laterally with the hinge there between. An absorbent sheet of mold free filter material is positioned in the lower chamber. The sheet of mold free filter material is adapted to collect moisture from a sweating beverage container on the base of the top portion.

1 Claim, 4 Drawing Sheets

FIG. 3
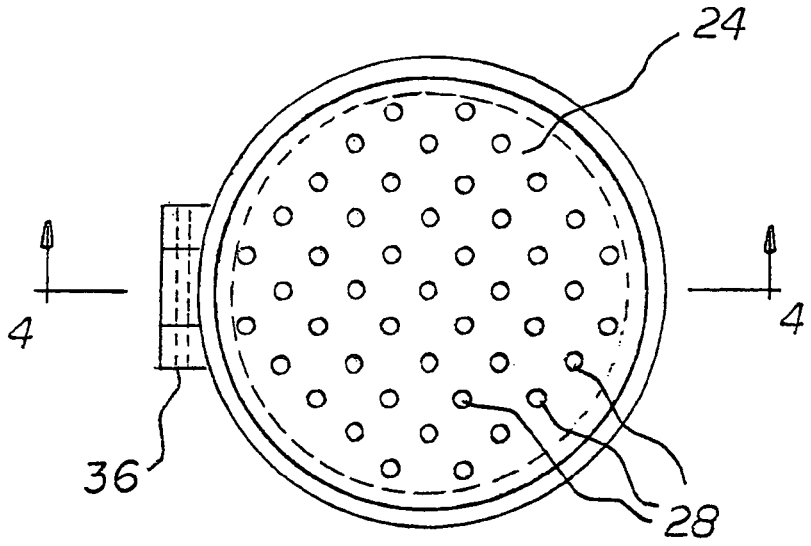
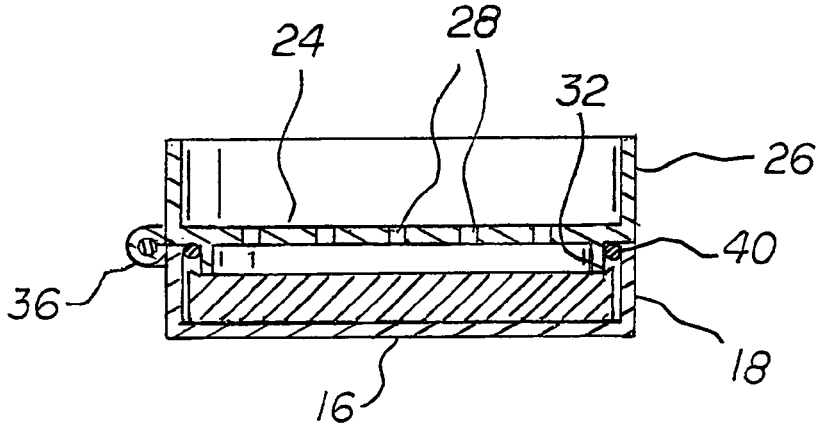
FIG. 4

FIG. 5
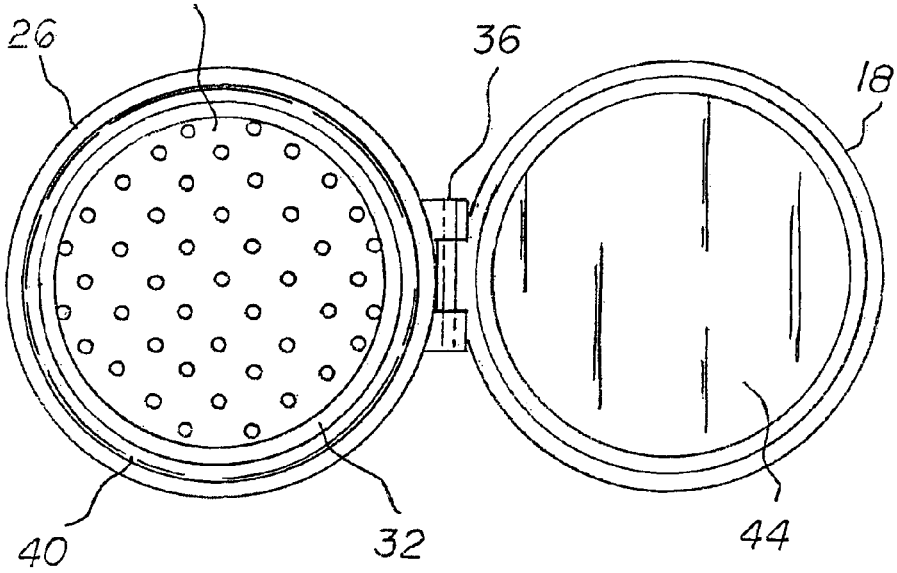
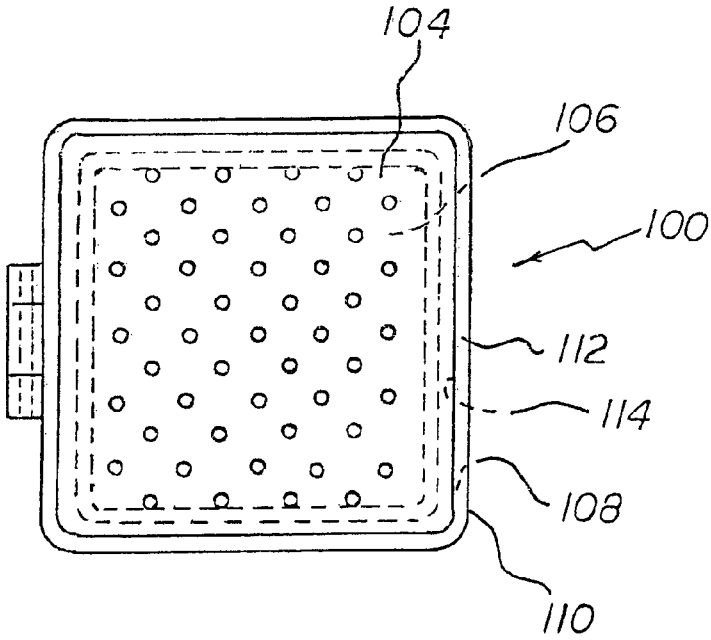
FIG. 6

FIG. 7
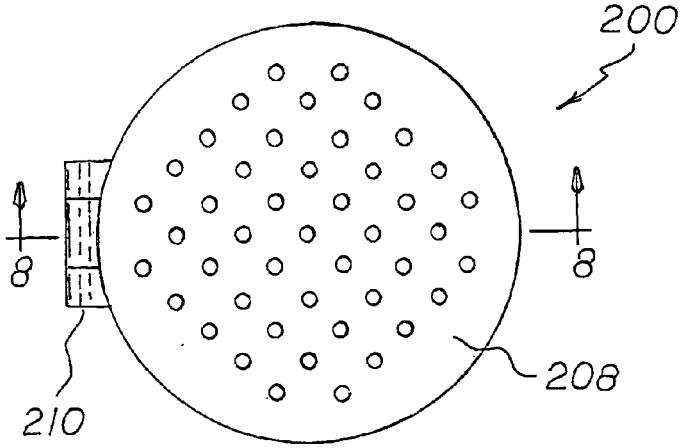
FIG. 8
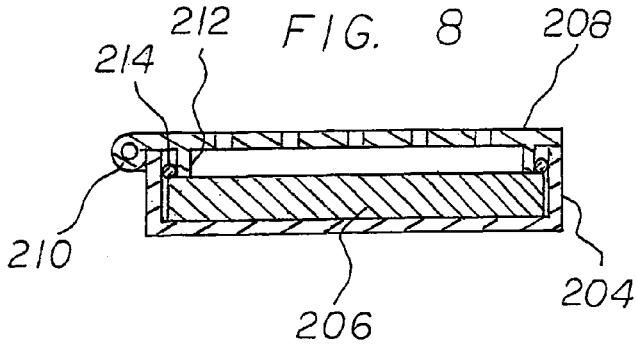
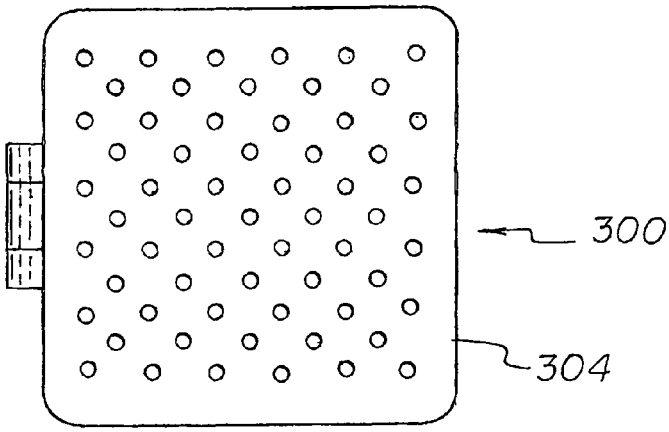
FIG. 9

NO-STICK COASTER SYSTEM

RELATED APPLICATION

This application is a continuation-in-part of co-pending application Ser. No. 12/924,406 filed Sep. 27, 2010 the subject matter of which is incorporated herein by reference.

BACKGROUND OF THE INVENTION

Field of the Invention

The present invention relates to a no-stick coaster system and more particularly pertains to interiorly collecting moisture from a glass and for precluding the sticking of the coaster to a supporting surface.

SUMMARY OF THE INVENTION

In view of the foregoing disadvantages inherent in the known types of coaster systems of known designs and configurations now present in the prior art, the present invention provides an improved no-stick coaster system. As such, the general purpose of the present invention, which will be described subsequently in greater detail, is to provide a new and improved no-stick coaster system and method which has all the advantages of the prior art and none of the disadvantages.

To attain this, the present invention essentially comprises a no-stick coaster system. First provided is a bottom portion. The bottom portion is in a cylindrical configuration. The bottom portion has an imperforate circular base. The base is provided below. The bottom portion has a circular open top. The top is provided above. The base has a cylindrical side wall. The side wall is provided between he top and base. In this manner a chamber is formed. The chamber has a depth. The base and the top have a common diameter. The side wall has a height. The height of the side wall is between 10 and 20 percent of the diameter of the base. The side wall has an interior perimeter. The side wall has an exterior periphery.

A top portion is provided. The top portion is in a cylindrical configuration. The top portion has an apertured circular base. The base is provided below. The top portion has a circular open top. The top is provided above. The top portion has a cylindrical side wall. The side wall is provided between the top and base. In this manner a chamber is formed. The chamber has a depth. The apertured base has a plurality of apertures. The base and the top have a common diameter. The diameter of the base and top of the top portion is essentially equal to the diameter of the base and top of the bottom portion. The side wall has a height. The height of the side wall is between 10 and 20 percent of the diameter of the base. The side wall has an interior perimeter. The side wall has an exterior periphery. The interior perimeter and exterior peripheries of the top portion are essentially equal to the interior and exterior peripheries of the bottom portion.

Provided next is an annular ring. The ring depends from the base of the top portion in a direction opposite from the side wall of the top portion. In this manner a recess is formed. The recess has a depth. The depth of the recess is between 20 and 40 percent of the depth of the chamber of the top portion.

A hinge is provided next. The hinge couples the top portion adjacent to its base and the bottom portion adjacent to its top. The hinge is adapted to pivot the top portion between an operative closed orientation and an inoperative orientation. In the operative closed orientation the top portion is overlying the bottom portion. Note FIGS. 2 and 5. In this inoperative open orientation the top and bottom portions are positioned laterally side by side with the hinge there between. Note FIGS. 1, 3 and 4.

Further provided is an elastomeric O-ring. The O-ring is positioned within the recess. The O-ring is provided in contact with the annular ring and the base of the upper portion and the side wall of the lower portion adjacent to its top when in the closed orientation.

Provided last is an absorbent sheet of mold free filter material. The sheet of mold free filter material is positioned in the chamber of the lower portion. The sheet of mold free filter material is adapted to collect moisture from a sweating glass on the base of the upper portion. The sheet of mold free filter material, when wet, is adapted to be discarded by pivoting the top portion to the open orientation and inverting the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved no-stick coaster system which has all of the advantages of the prior art coaster systems of known designs and configurations and none of the disadvantages.

It is another object of the present invention to provide a new and improved no-stick coaster system which may be easily and efficiently manufactured and marketed.

It is further object of the present invention to provide a new and improved no-stick coaster system which is of durable and reliable constructions.

An even further object of the present invention is to provide a new and improved no-stick coaster system which is susceptible of a low cost of manufacture with regard to both materials and labor, and which accordingly is then susceptible of low prices of sale to the consuming public, thereby making such no-stick coaster system economically available to the buying public.

Even still another object of the present invention is to provide a no-stick coaster system for interiorly collecting moisture from a glass and for precluding the sticking of the coaster to a supporting surface.

Lastly, it is an object of the present invention to provide a new and improved no-stick coaster system. A bottom portion is provided in a cylindrical configuration. The bottom portion has an imperforate base below and an open top above and a side wall provided there between. In this manner an upper chamber is formed. A top portion similarly configured top portion is provided to form a lower chamber. The base of the top portion has a plurality of apertures. A hinge couples the top and bottom portions. The hinge is adapted to pivot the top portion between an operative closed orientation and an inoperative open orientation. In this operative closed orientation the top portion is overlying the bottom portion. In the inoperative open orientation the top and bottom portions are positioned laterally with the hinge there between. An absorbent sheet of mold free filter material is positioned in the lower chamber. The sheet of mold free filter material is adapted to collect moisture from a sweating beverage container on the base of the top portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the no-stick coaster system taken along line 3-3 of FIG. 1.

FIG. 4 is a cross sectional view taken along line 4-4 of FIG. 3.

FIG. 5 is a plan view of the no-stick coaster system taken along line 5-5 of FIG. 4.

FIG. 6 is a plan view similar to FIG. 3 but illustrating an alternate embodiment of the invention.

FIG. 7 is a plan view of a the no-stick coaster system constructed in accordance with another alternate embodiment of the invention.

FIG. 8 is a cross sectional view taken along line 8-8 of FIG. 7.

FIG. 9 is a plan view of a the no-stick coaster system constructed in accordance with a final alternate embodiment of the invention.

The same reference numerals refer to the same parts throughout the various Figures.

DESCRIPTION OF THE PREFERRED EMBODIMENT

Figure 1:
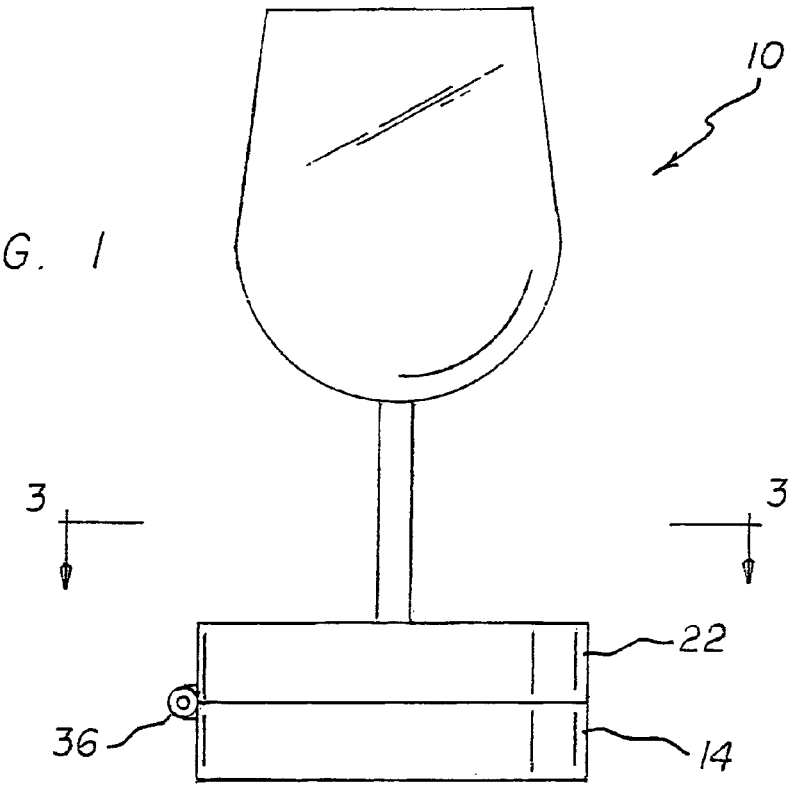
FIG. 1 is a side elevational view of a no-stick coaster system constructed in accordance with the principles of the present invention, the system being shown in use.

With reference now to the drawings, and in particular to FIG. 1 thereof, the preferred embodiment of the new and improved no-stick coaster system embodying the principles and concepts of the present invention and generally designated by the reference numeral 10 will be described.

The present invention, the no-stick coaster system 10 is comprised of a plurality of components. Such components in their broadest context include a bottom portion, a top portion, a hinge and an absorbent sheet of mold free filter material. Such components are individually configured and correlated with respect to each other so as to attain the desired objective.

First provided is a bottom portion 14. The bottom portion is in a cylindrical configuration. The bottom portion has an imperforate circular base 16. The base is provided below. The bottom portion has a circular open top. The top is provided above. The base has a cylindrical side wall 18. The side wall is provided between he top and base. In this manner a chamber is formed. The chamber has a depth. The base and the top have a common diameter. The side wall has a height. The height of the side wall is between 10 and 20 percent of the diameter of the base. The side wall has an interior perimeter. The side wall has an exterior periphery.

A top portion 22 is provided. The top portion is in a cylindrical configuration. The top portion has an apertured circular base 24. The base is provided below. The top portion has a circular open top. The top is provided above. The top portion has a cylindrical side wall 26. The side wall is provided between the top and base. In this manner a chamber is formed. The chamber has a depth. The apertured base has a plurality of apertures 28. The base and the top have a common diameter. The diameter of the base and top of the top portion is essentially equal to the diameter of the base and top of the bottom portion. The side wall has a height. The height of the side wall is between 10 and 20 percent of the diameter of the base. The side wall has an interior perimeter. The side wall has an exterior periphery. The interior perimeter and exterior peripheries of the top portion are essentially equal to the interior and exterior peripheries of the bottom portion.

Provided next is an annular ring 32. The ring depends from the base of the top portion in a direction opposite from the side wall of the top portion. In this manner a recess is formed. The recess has a depth. The depth of the recess is between 20 and 40 percent of the depth of the chamber of the top portion.

Figure 2:
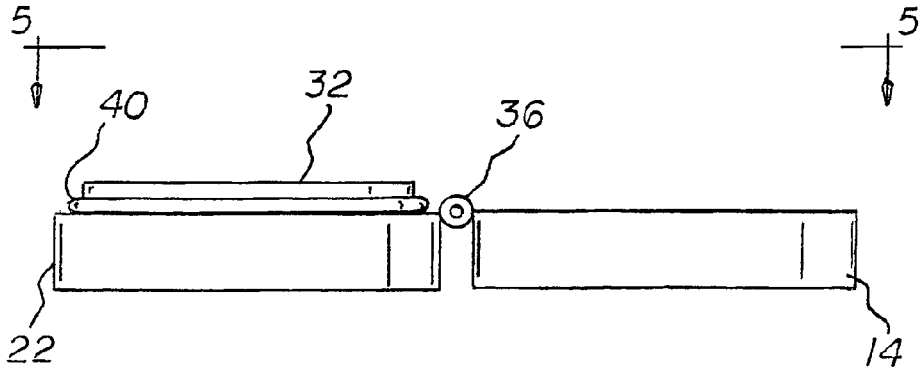
FIG. 2 is a side elevational view shown in FIG. 1 but in the open orientation.

A hinge 36 is provided next. The hinge couples the top portion adjacent to its base and the bottom portion adjacent to its top. The hinge is adapted to pivot the top portion between an operative closed orientation and an inoperative orientation. In the operative closed orientation the top portion is overlying the bottom portion. Note FIGS. 2 and 5. In this inoperative open orientation the top and bottom portions are positioned laterally side by side with the hinge there between. Note FIGS. 1, 3 and 4.

Further provided is an elastomeric O-ring 40. The O-ring is positioned within the recess. The O-ring is provided in contact with the annular ring and the base of the upper portion and the side wall of the lower portion adjacent to its top when in the closed orientation.

Provided last is an absorbent sheet of mold free filter material 44. The sheet of mold free filter material is positioned in the chamber of the lower portion. The sheet of mold free filter material is adapted to collect moisture from a sweating glass on the base of the upper portion. The sheet of mold free filter material is preferably adapted to change colors when wet. Further, the filter material is adapted to be discarded when wet by pivoting the top portion to the open orientation and inverting the system.

Reference is now made to the alternate embodiment 100 of the invention as illustrated in FIG. 5. Apertured and imperforate bases 104, 106 are provided. Upper and lower portions 112, 114 are provided. The upper and lower portions have side walls 108, 110. The upper and lower portions and side walls are all formed in a rectangular configuration.

Another alternate embodiment of the invention is illustrated in FIGS. 7 and 8. In such system 200, the bottom portion 204 forms a chamber of a fixed size. The absorbent mold free filter material 206 fills the majority of the chamber. In addition, the top portion 208 has a flat upper surface, laterally spaced from the hinge 210. In this embodiment, further included is an annular ring 212 depending from the apertured base of the top portion in a direction opposite from the side wall of the top portion. Thus formed is a recess with an elastomeric ring 214 positioned within the recess. The ring is adapted to be in contact with the annular ring and the absorbent sheet of mold free filter material 206 when in the closed orientation.

Although the elastomeric ring is illustrated to be in an O-shaped configuration, the elastomeric ring is adapted to br formed with a cress section of a wide variety of shapes including a square.

The final alternate embodiment of the invention is illustrated in FIG. 9. In such system 300, the imperforate and apertured bases 304 as well as the side walls of the upper and lower portions are all formed in a rectangular configuration, preferably a square configuration.

Note is taken that the coasters of the present invention are adapted to be fabricated of any of a plurality of rigid mold free filter materials, metal or plastic or composites. In addition, the coasters of the present invention are adapted to be provided in any of a plurality of colors with any of a plurality of designs and/or indicia.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A no-stick coaster system (10) for interiorly collecting moisture from a glass and for precluding the sticking of the coaster to a supporting surface, the system comprising, in combination:

a bottom portion (14) in a cylindrical configuration formed with an imperforate circular base (16) below and a circular open top above with a cylindrical side wall (18) there between to form a chamber with a depth, the base and the top having a common diameter, the side wall having a height between 10 and 20 percent of the diameter of the base, the side wall having an interior perimeter and an exterior periphery;

a top portion (22) in a cylindrical configuration formed with an apertured circular base (24) below and a circular open top above with a cylindrical side wall (26) there between to form a chamber with a depth, the apertured base having a plurality of apertures (28), the base and the top of the top portion having a common diameter essentially equal to the diameter of the base and top of the bottom portion, the side wall of the top portion having a height between 10 and 20 percent of the diameter of the base of the top portion, the side wall of the top portion having an interior perimeter and an exterior periphery essentially equal to the interior and exterior peripheries of the bottom portion;

an annular ring (32) depending from the base of the top portion in a direction opposite from the side wall of the top portion to form a recess, the recess having a depth between 20 and 40 percent of the depth of the chamber of the top portion;

a hinge (36) coupling the top portion adjacent to the base of the top portion and the bottom portion adjacent to the top of the bottom portion, the hinge adapted to pivot the top portion between an operative closed orientation with the top portion overlying the bottom portion, and an inoperative open orientation with the top and bottom portions positioned laterally side by side with the hinge there between;

an elastomeric O-ring (40) positioned within the recess, the O-ring being in contact with the annular ring and the base of the top portion and the side wall of the bottom portion adjacent to the top of the bottom portion when in the closed orientation; and an absorbent sheet of mold free filter material (44) positioned in the chamber of the bottom portion, the sheet of mold free filter material being adapted to collect moisture from the glass on the base of the top portion, the sheet of mold free filter material adapted to change color when wet and to be discarded when wet by pivoting the top portion to the open orientation and inverting the system.

* * * * *